United States Patent [19]

Robinson et al.

[11] 4,111,008

[45] Sep. 5, 1978

[54] SWEATER BLANK AND METHOD OF KNITTING SAME

[75] Inventors: Frank Robinson; Nigel Stephen Whatmough, both of Breaston, Great Britain

[73] Assignee: Courtaulds Limited, London, England

[21] Appl. No.: 819,472

[22] Filed: Jul. 27, 1977

[30] Foreign Application Priority Data

Aug. 10, 1976 [GB] United Kingdom ..... 33209/76

[51] Int. Cl.[2] ..... A41B 9/06

[52] U.S. Cl. ..... 66/176

[58] Field of Search ..... 66/175, 174

[56] References Cited

U.S. PATENT DOCUMENTS

| | | | |
|---|---|---|---|
| 3,057,178 | 10/1962 | Konklin | 66/176 |
| 3,561,000 | 2/1971 | Wignall | 66/176 |
| 3,664,156 | 5/1972 | Betts | 66/176 |

FOREIGN PATENT DOCUMENTS

| | | | |
|---|---|---|---|
| 435,308 | 11/1974 | U.S.S.R. | 66/176 |

*Primary Examiner*—Ronald Feldbaum

*Attorney, Agent, or Firm*—Davis, Hoxie, Faithfull & Hapgood

[57] ABSTRACT

A method of knitting a blank for making up into a sleeved garment includes the steps of knitting a tube on opposed needle beds of a knitting machine to constitute a sleeve for the garment, each circular course of this tube being located partly on one of the needle beds and partly on the other, knitting fabrics each on a different one of the needle beds to form the front and rear of the garment, respectively, each of these two fabrics being knitted integrally with the aforementioned sleeve tube, having courses extending in the direction from the neck to the waist of the garment and having wales which are a continuation of the wales of the sleeve tube, and knitting a further tube on the opposed needle beds to constitute the other sleeve of the garment, each circular course of this further tube being located partly on one of the needle beds and partly on the other, this further tube being knitted integrally with the aforementioned two fabrics and having wales which are a continuation of wales in these two fabrics.

Methods are described which result in the sleeves being downwardly inclined with respect to the body in the finished garment, in shaping of the body of the garment, and in the production of stripes which will extend vertically in the body of the garment, when worn, or around the sleeves of the garment.

9 Claims, 2 Drawing Figures

SWEATER BLANK AND METHOD OF KNITTING SAME

Figure 1:
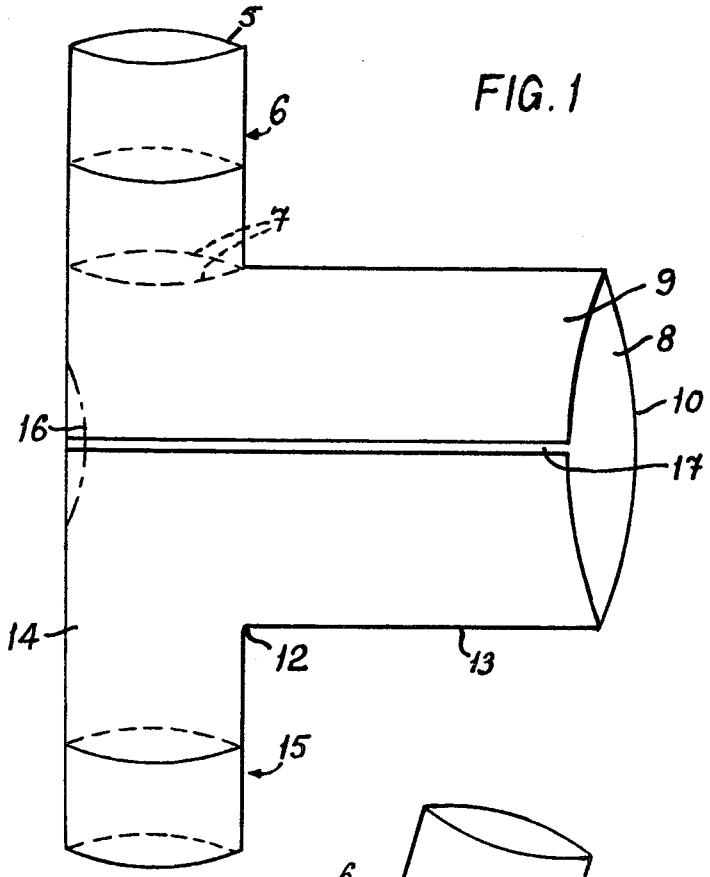

This invention relates to a method of knitting a sleeved garment blank in one piece and to the garment made from the blank.

In the methods of manufacturing garments conventionally used in the knitting industry at present, separate garment panels are knitted and are subsequently seamed together to make a garment. The present invention provides a way of simplifying this manufacturing process by knitting the garment in one piece, so that little seaming and finishing is required, thereby enabling garments to be made more cheaply and using less labour than required when employing conventional garment manufacturing procedures.

According to the invention, a method of knitting a blank for a sleeved garment comprises knitting a tube on opposed needle beds to constitute a sleeve for the garment, each circular course of the tube being located partly on one needle bed and partly on the other, knitting two fabrics, one on one needle bed to form the front of the garment and the other on the other needle bed to form the rear of the garment, each of said two fabrics being knitted integrally with said sleeve tube, having courses extending in the direction from neck to waist of the garment and having wales which are a continuation of wales of said tube, and knitting a further tube to constitute the other sleeve of the garment, each circular course of said further tube being located parly on one needle bed and partly on the other, said further tube being knitted integrally with said two fabrics and having wales which are a continuation of wales in said fabrics.

The invention also includes a garment blank comprising tubular knitted sleeves, a fabric constituting the garment front, and a fabric constituting the garment rear, each integral with both of said tubular sleeves, and there being knitted wales each of which extends in continuous manner through both sleeves and from one side to the other of one of said front and rear fabrics, and courses of knitting extending in said front and rear fabrics in the direction from waist to neck.

Further aspects of the invention are a garment blank produced by the method described above and a garment made from such a garment blank or from a garment blank as described in the preceding paragraph.

Before commencing and after completing the two body fabrics, in the method described above, one of which is knitted on each of the opposed needle beds, one or more courses of rib knitting may be knitted to join the two body fabrics together along their side edges, in the region below the arm pit of the garment.

The two body fabrics may be joined together during knitting along their upper edges to close off the upper shoulder region of the garment. This may be done, for example by knitting the two body fabrics using U-shaped courses. A neck opening may be left by knitting the parts of the two body fabrics associated with the neck opening using full reciprocation of separate yarn carriers on the two needle beds.

A front opening, for example for a cardigan, may be formed by inserting a draw-thread course in the front body fabric, or, alternatively, by casting off all the stitches of that fabric at a suitable course in knitting the fabric and immediately recommencing knitting of that fabric by starting up knitting once more on bare needles.

In order to produce a sleeve which is downwardly inclined with respect to the body in the finished garment, courses of the sleeve and/or body in the shoulder region may be formed as U-shaped courses, the closed end of each U-shaped course lying in the upper shoulder region of the garment and some of the U-shaped courses being knitted shorter than others to produce the desired sleeve inclination.

The body fabrics may be shaped to give a body which is tapered or flared, or both, by varying the length of the courses of the body fabrics.

Figure 2:
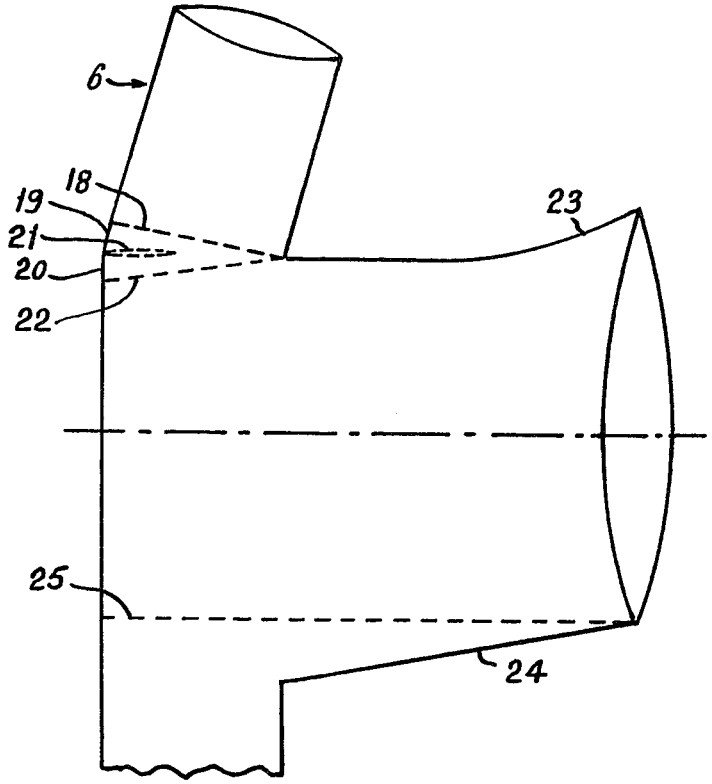

The invention will be further described, by way of example, with reference to the accompanying drawing, in which FIGS. 1 and 2 illustrate manufacture of garment blanks by the method of the invention.

The knitting method illustrated in FIG. 1 is carried out on a knitting machine having opposed needle beds in which knitting can be stopped on some needles, and loops held on those needles, whilst adjacent needles continue to knit. An example of such a machine is the flat V-bed machine produced by the firm of Edouard Dubied & Cie, Switzerland and designated the JDRPM machine. That machine employs a presser foot to push down the knitted loops in place of the usual take-down rollers which normally pull the knitted fabric away from the needles.

In carrying out the method of FIG. 1, knitting may be begun at the extremity 5 of a sleeve and the sleeve is knitted in the form of a tube, each circular course of the tube being located partly on needles of one needle bed of the machine and partly on needles of the other bed. The sleeve may be begun on bare needles in which case the first course is conveniently a rib course. Alternatively, a draw thread may be introduced before the first tubular course of the sleeve to separate the sleeve from a previous blank. When the sleeve tube has been completed, during the next traverse of the cam carriage, part-courses 7 are knitted separately on the two needle beds to constitute the first courses of the shoulder regions of the body fabrics 8 and 9. In the same traverse of the cam carriage, a part-course of rib knitting is formed, in continuation of the part-courses 7 and extending from the arm pit of the garment to the lower extremity 10 of the body (in the present case the waist). Thereafter, the knitting of the front body fabric 9 and the rear body fabric 8 is continued using U-shaped courses which extend in the direction from neck to waist of the garment. Each limb of each U-shaped course is formed on one of the needle beds and lies in either the front or the rear body fabric. The closed end of each U-shaped course lies at the upper shoulder region of the garment and joins the two body fabrics together at their upper edges.

When the body fabrics 8 and 9 are completed, they may be cast off the needles along a line 13 from the arm pit 12 to the lower extremity 10 of the garment or alternatively they may be joined together in this region by knitting a number of courses in rib structure along the line 13 before casting off. If courses of rib are knitted, the needles holding loops in the shoulder region 14 of the blank are maintained out of action whilst the rib courses are being formed. After the formation of the rib courses or after the casting off of loops along the line 13, the needles in the two beds holding loops in the region 14 are operated to knit a further sleeve 15 for the blank in tubular form. The blank may then be cast off from the needles or a circular draw thread course may be knitted before commencing the next blank by knitting tubular set up courses and a tubular sleeve.

The garment blank produced by the method just described has two sleeves 6 and 15 knitted in tubular form, which are integral with front and rear body fabrics 8 and 9. Wales extend continuously through the sleeves and from one side to the other of each body fabric whereas the courses of knitting extend around the sleeves and in the direction from waist to neck in the body fabrics.

To make a garment from the blank, the body fabrics 8 and 9 are simultaneously cut along the line 13, to sever the rib fabric, if any, and are seamed together along this line. A neck opening 16 is cut out and seamed or trimmed, and the extremities of the sleeves 6 and 15 are seamed, any rib fabric being cut away.

If desired, the rib course along the sides of the garment body below the arm pits may be omitted and the front and rear body fabrics may be knitted separately, that is using normal reciprocation of the separate yarn carriers for the two needle beds. Thus separate courses are knitted on the two needle beds and the fabrics 8 and 9 are not joined in the upper shoulder region as when U-shaped courses are knitted.

In order to reduce or eliminate the quantity of fabric which must be cut to waste in forming the neck opening, an opening may be left in the neck region of the blank even when, in general, U-shaped courses are used to knit the body fabrics 8 and 9. The opening is left by using normal reciprocation of separate yarn carriers for the two needle beds.

If the blank is to be made into a cardigan or jacket, a front opening 17 can be left in the body fabric 9 either by inserting a draw thread in the body fabric 9 only, along the centre line of this fabric or by casting off the stitches along this line and immediately recommencing knitting again on the same (now bare) needles.

FIG. 2 illustrates a variation of the method of the invention in which the sleeves of the garment blank have a downward inclination in relation to the body. This is brought about in relation to the sleeve 6 by ceasing to knit in tubular form at the course 18 and thereafter knitting U-shaped courses the closed ends of which lie at first in the upper edge 19 of the sleeve 6 and later in the upper shoulder region 20 of the body of the blank. The U-shaped courses are made successively shorter, needles being taken progressively out of action on both needle beds at the open end of the U. The needles taken out of action nevertheless retain their knitted loops. The progressive shortening of the courses continues to course 21 and thereafter the courses are progressively increased in length once more until at the course 22 knitting across the whole width of the sleeve is restored. The knitting of the body fabrics 8 and 9 is then carried out as described above. A similar procedure, in reverse, produces a similar inclination of the other sleeve of the garment blank. The body of the garment blank may be shaped as illustrated in FIG. 2. Two examples of shaping are shown. At the upper side edge of the body in the Figure a flare can be seen, whilst at the lower side edge the body is tapered. Of course, in a real garment one would not employ a flare at one side of the body and a taper at the other but a combination of taper and flare may be used, the upper part of the body below the arm pits being tapered and the lower part near the waist or lower extremity of the body flared, for example.

The flare 23 shown in FIG. 2 is produced by knitting the first course of each body fabric 8 or 9, whether a combined course of rib for the two fabrics or separate courses on the two beds, at full body length and thereafter knitting a number of shorter courses of progressively increasing length at the lower extremity of the body. Such courses are separate courses on each needle bed and not U-shaped courses, and the increase in length is achieved by introducing needles in the direction towards the shoulder of the blank, all the needles holding loops of the first body courses being operated to retain those loops if temporarily inactive.

The taper 24 shown in FIG. 2 is formed by progressively decreasing the length of body courses from course 25. The decreasing courses may be U-shaped courses, needles being removed from knitting action in the direction towards the shoulder region and either casting off their loops or retaining them. If loops are retained a number of rib courses may be knitted finally, to close off this side of the body temporarily as described above.

The garment blanks of FIGS. 1 and 2 are easily knitted with stripes which will extend vertically in the body of the garment, when worn, or around the sleeves of the garment. The stripes are formed by supplying differently coloured yarns to the needles at different stages of the knitting process using additional yarn carriers. Preferably, when knitting the body of the blank, the yarns are introduced from the waist of the garment which is in any case eventually finished by seaming or forming a welt.

The knitting of the sleeves in the form of tubes may be effected by knitting along one needle bed and then in the opposite direction along the other needle bed, and so on. Other methods of forming a tube may also be used. For example, a front yarn carrier may be arranged to supply yarn to needles of the rear bed and a rear yarn carrier may be arranged to supply yarn to needles of the front bed as the carriers move along the needle beds one ahead of the other. After completion of these carrier movements, the carrier which led is arranged to be the leading carrier again for the next movement along the needle beds, this time in the opposite direction. The same carrier continues to lead in succeeding carrier movements and this coupled with the arrangement of front and rear carriers supplying yarn to the opposite needle beds causes the yarn to cross over and interlace at the edges of the two single jersey fabrics formed on the machine thus in effect forming a knitted tube. A further method of forming a tube, in which, as in the previously described method, the same yarn carrier always supplies yarn to the same needle bed, involves tucking or knitting yarn supplied to needles of one bed onto the needle holding the edge loop of the fabric being knitted on the other needle bed. This procedure is carried out at both edges of the two fabrics thus joining them at these edges and producing the tube.

What is claimed is:

1. In a method of knitting a blank for a sleeved garment wherein the sleeves of the blank are formed integrally with the blank in the knitting process, the improvement comprising, (a) knitting a tube on opposed needle beds to constitute a sleeve for the garment, each circular course of the tube being located partly on one needle bed and partly on the other, (b) continuing knitting to make two fabrics integral with said sleeve tube, one on one of said needle beds to form the front of the garment and the other on the other needle bed to form the rear of the garment, wherein each of said two fabrics has courses extending in the direction from neck to waist of the garment and has wales which are a direct continuation of wales of said tube and extend in the direction from side to side of the finished garment, and (c) further continuing knitting to make a further tube to constitute the other sleeve of the garment integral with said two fabrics, wherein each circular course of said further tube is located partly on one needle bed and partly on the other, and has wales which are a direct continuation of wales in said fabrics.

2. A method according to claim 1, wherein before commencing and after completing said front and rear body fabrics of 1(b) at least one course of rib knitting is formed in each case to join said two fabrics together along their side edges in the regions below the armpits of the garment.

3. A method according to claim 1, wherein said front and rear fabrics of 1(b) are joined together, during knitting, along the upper shoulder line of the body.

4. A method according to claim 3, wherein said front and rear fabrics are joined by forming them from U-shaped courses, the closed end of each U-shaped course lying in said upper shoulder line.

5. A method as claimed in claim 1, wherein, in order to cause the sleeves to be downwardly inclined with respect to the body in the finished garment, courses of at least one of each upper sleeve region and the associated body shoulder region are formed by U-shaped courses, the closed end of each U-shaped course lying along said upper shoulder line of the garment, and some of said U-shaped courses are knitted shorter than others to produce the desired sleeve inclination.

6. In a blank for a sleeved garment wherein the sleeves of the blank are formed integrally with the blank in the knitting process, the improvement that the blank comprises;

(a) tubular knitted sleeves, (b) fabric for the garment front and fabric for the garment rear each integral with both of said tubular sleeves, (c) the knitted wales of either sleeve extending in continuous manner from one side to the other of one of said front and rear fabrics, and into said other sleeve, and (d) the courses of knitting throughout said front and rear fabrics extending in the direction from waist to neck.

7. A blank according to claim 6 wherein said two fabrics are joined together along their side edges below the armpit regions of the garment by at least one course of rib knitting, 8. A blank according to claim 6 wherein said two fabrics are joined to one another along the upper shoulder line of the garment.

9. A blank according to claim 8 wherein said two fabrics are formed of U-shaped courses and the closed end of each U lies in said upper shoulder line.

* * * * *